United States Patent [19]

Oron et al.

[11] 3,953,732

[45] Apr. 27, 1976

[54] DYNAMIC MASS SPECTROMETER

[75] Inventors: Moshe Oron; Yehuda Paiss, both of Rehovot, Israel

[73] Assignee: The University of Rochester, Rochester, N.Y.

[22] Filed: Sept. 28, 1973

[21] Appl. No.: 401,883

[52] U.S. Cl. ..... 250/287; 250/281; 250/282

[51] Int. Cl.[2] ..... H01J 39/34

[58] Field of Search ..... 250/286, 287, 290, 293, 250/298, 299, 282, 281

[56] References Cited

UNITED STATES PATENTS

| | | | |
|---|---|---|---|
| 2,790,080 | 4/1957 | Wells | 250/287 |
| 3,582,648 | 6/1971 | Anderson | 250/287 |
| 3,723,246 | 3/1973 | Lubin | 176/1 |

*Primary Examiner*—James W. Lawrence
*Assistant Examiner*—B. C. Anderson
*Attorney, Agent, or Firm*—Martin LuKacher

[57] ABSTRACT

A pulse-type ion source derived from a pulse laser produced plasma provides an ion beam which is analyzed in a time-dependent field which varies monotonically as an inverse function of time for the pulse period. Ions of common charge to mass ratio are collected at different points after executing a trajectory, which, because of the time dependent nature of the field, traverses the same path for ions of the same charge to mass ratio, irrespective of their initial velocity when entering the field; thus, facilitating the determination of the mass, charge and energy spectrums of the entire population of particles emitted in pulses or bursts, simultaneously and even from individual bursts.

26 Claims, 6 Drawing Figures

DYNAMIC MASS SPECTROMETER

The present invention relates to methods of and apparatus for mass spectrometry and particularly to an improved method of and system for the electrodynamic analysis of compositions of matter.

The invention is especially suitable for use in the analysis of ions blown off laser produced plasmas for the purpose of analyzing plasma parameters, such as the charge, mass and energy distributions thereof, as well as the composition of the plasma. When plasmas and ions resulting therefrom are produced in bursts as in laser fusion reactions, (see for example, Lubin, U.S. Pat. No. 3,723,246) the invention can be used to determine the parameters and elemental composition of the plasmas, simultaneously from a single burst and without the need for many bursts. The invention, however, is generally applicable to mass spectrometry and for determining the charge, mass and energy distributions as well as the elemental compositions of matter, rapidly and with high resolution.

The art of mass spectrometry has developed from crude types of devices (see W. Kaufman, Phys. 2.4 (55) 1903), to complex combinations of electrostatic, electromagnetic and radio frequency spectrometers, in some cases using cyclically scanning fields synchronized with swept displays to provide a spectrum display (see U.S. Pat. Nos. 2,806,955; 2,752,502; 2,806,955; 3,235,725; 3,457,404; 3,555,271; and 3,673,404). In all such spectrometers, separation of the ions is predicated upon their charge to mass ratio ($q/m$); different ions having different $q/m$ being subject to different trajectories when subjected to an electric or magnetic field. The trajectories and thus the focussing of the various ions and the ability of the spectrometer to separate them for analysis depend in significant part upon the energy (viz., velocity) which the ions possess when entering the field. Spectrometers of the conventional type, including those in the literature and patents discussed above, are not capable of accurately analyzing ions from a source which produces them with a wide energy spread. In order to obviate the problem of improper operation in the spectrometer due to the differences in energy of the ions to be analyzed, spectrometers have been provided with filters or other means for singling out only those ions within a small energy range. Typical of electrostatic devices for the purpose of limiting the energy range of ions which enter the analyzing field is the electrostatic device shown in U.S. Pat. No. 2,911,532 (see also F. J. Allen, Rev. Sci. Instr. 42,1423 (1971)).

Inasmuch as only a small energy range is available for accurate analysis in a conventional spectrometer, several bursts, as from the bursts of plasma produced by several laser pulses which are incident on the sample to be analyzed, have heretofore been needed to analyze the entire spectral distribution (viz., the charge, mass and energy distribution) of sources which produce ions having a wide energy spread. Inasmuch as successive bursts, especially in the case of laser shots, change the properties of the material being tested, the resulting distribution can be erratic and unstable thus reducing the scientific value of the data.

Conventional spectrometers using swept or cyclical scanning fields with synchronized displays (see U.S. Pat. Nos. 3,235,725; 2,752,502; and 3,673,404) are also limited to sources of ions of small energy range. Such spectrometers, moreover have the further drawback of being incapable, because of the speed limitations of the scanning or swept fields and displays synchronous therewith, of producing spectrum displays of ions from short bursts, such as are produced by laser shots.

It has now been discovered, in accordance with this invention, that both the capability of handling and the analyzing of ions of wide energy range from sources which occur in bursts of short duration can be accomplished simultaneously by utilizing a field which is time dependent. By virtue of this field, all ions of equal q/m have the same trajectory and will be focussed at the same collection point regardless or their velocity of energy upon entering the field. Moreover, the time dependent field enables the simultaneous distribution of mass, charge and energy spectrums of ions emitted from a single burst and without the need for successive bursts in each of which ions of different energy range are separately analyzed, as in conventional spectrometry. The invention is therefore applicable for the analysis of the composition, charge state and energy of ions from various types of plasma bursts, including laser-matter interactions, as in thermonuclear reactions, and in weaponry as the products of explosions, and in electron beam, X-ray and a wide variety of radiant energy-matter interactions.

The invention also facilitates the analysis of matter as in the analysis of the surface composition of materials and in composition control for processes using lasers or electron beams or other radiant energy, as in welding machines.

Accordingly, it is an object of the present invention to provide improved methods of and apparatus for spectrometry.

It is another object of the present invention to provide an improved method of and apparatus for spectrometry which uses a magnetic or an electric field and which can determine from bursts of particles, especially when the burst is of short duration with respect to the time of flight of the particles in the field, the mass charge and energy spectrums of the particles and also the relative yields of particles of different elements in each burst.

It is still a further object of the present invention to provide an improved method of and apparatus for spectrometry which, from an individual burst of charged particles, simultaneously determines the mass, charge and energy spectrum thereof.

It is still a further object of the present invention to provide improved methods for and means of analysis of laser produced plasmas, even when produced by pulse lasers in bursts.

It is still a further object of the present invention to provide improved methods of and means for on-line, real time analysis of the composition of ion or other charged particle bursts, as are produced by transient events, e.g., radiant energy-matter interactions, where the radiant energy can be from various sources such as lasers, electron beams, X-rays and the like.

It is still a further object of the present invention to provide an improved system for and method of analysis of compositions of surfaces where ions are blown off or emitted therefrom as by radiant energy surface interactions in applications such as (a) analysis of the surface composition of metallic materials, (b) analysis of organic matter which generates ionic beams, such as contain molecular ions, and (c) continuous composition control as of the composition of laser or electron beam welds.

It is still a further object of the present invention to provide an improved mass spectrometer having g/m path stability and which is operative to collect all ions having the same q/m at the same point in space (the collection point) regardless of their kinetic energy; thus facilitating the collection and integration of ion current and/or further analysis of the composition of the material from which the ions are produced.

It is still a further object of the present invention to provide an improved mass spectrometer which is less affected by space charges concomitant to plasmas being analyzed.

It is still a further object of the present invention to provide an improved mass spectrometer which is extremely rapid in operation in the collection of ions and in the generation of resulting ion currents for measurement.

It is still a further object of the present invention to provide an improved mass spectrometer which is easy to calibrate.

It is still a further object of the present invention to provide an improved mass spectrometer for determining the composition of plasmas, as are produced by high power laser-matter interactions.

It is still a further object of the present invention to provide an improved mass spectrometer in which all ions with common q/m are deflected to the same spacial collection point regardless of their velocity of energy.

It is still a further object of the present invention to provide an improved mass spectrometer which analyzes ions of different q/m with high resolution.

It is still a further object of the present invention to provide an improved mass spectrometer which can be implemented in a structure of reasonable size, say approximately 2 feet in length.

Briefly described, the invention may be carried out by projecting a beam of particles into an analyzing region. A field, either electric or magnetic, is established in the region which deflects the particles independently of their initial velocity along paths of lengths which are dependent upon the mass, particularly the $q/m$, of the particles. Particles having the same $q/m$ execute the same trajectories and are collected at the same spacial points. The currents resulting from these particles may be processed to determine the charge, mass and energy distribution as well as the elemental composition of the particles. More particularly, the field is a time dependent field which, when the beam is in a burst starts substantially on the onset of the burst and has a variation of the form $Eo/t^2$ where Eo is the maximum intensity of the field and t is the elapsed time from the onset of the burst. In the case where a magnetic field is used, the field is a similar time dependent of the form $B=B_o/t$ where $B_o$ is the maximum flux density of the field and t is the elapsed time from the onset of the burst. The parameters and composition of the burst are determinable from a single burst, inasmuch as the initial velocity or energy of the particles does not substantially affect the trajectory or path executed by the particles in the field.

The foregoing and other objects, advantages and features of the invention will become more readily apparent to those skilled in the art from a reading of the following description when taken in connection with the accompanying drawings in which.

Figure 1:
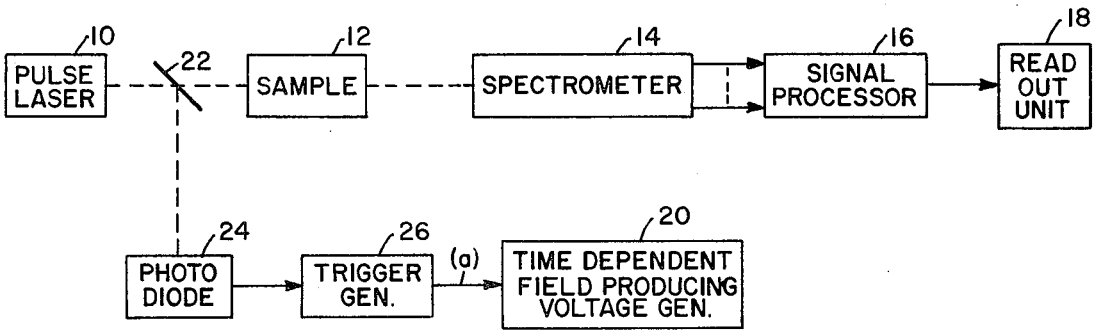
FIG. 1 is a block diagram showing a system of mass spectrometry in accordance with the invention.
Figure 2:
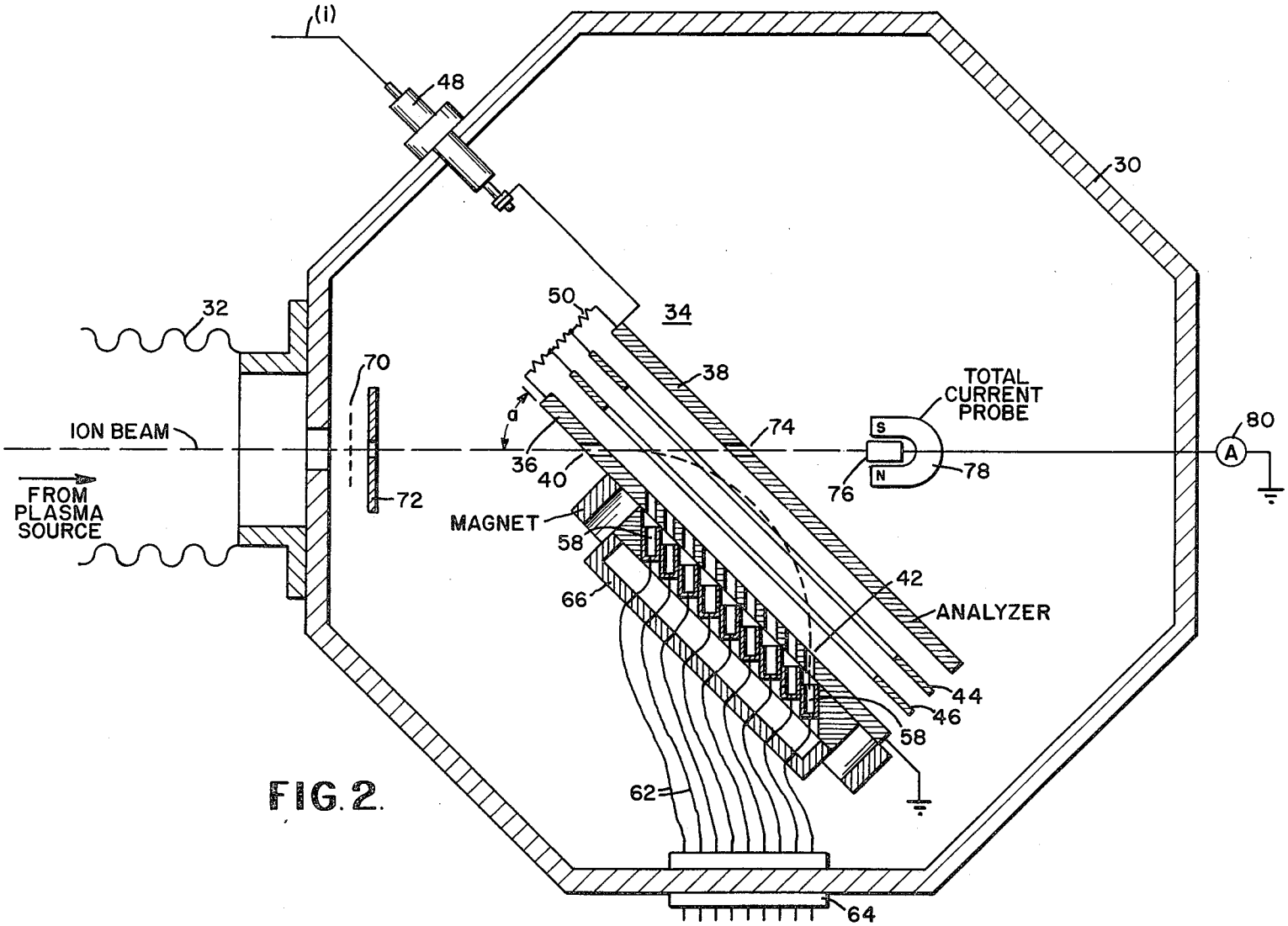
FIG. 2 is a sectional plan view schematically showing a mass spectrometer embodying the invention.

Referring to FIG. 1 there is shown a system for the diagnosis of laser produced plasmas which embodies the invention. A pulse laser 10, of extremely high power irradiates a sample 12 with an intense laser beam of short duration. The sample 12 may be a pellet containing deuterium and tritium, (D-T), as used in laser fusion interactions (see the above referenced Lubin patent). Irradiation of the sample vaporises the sample, or a portion thereof, and ionizes and further heats the resulting vapor to produce a burst of high temperature, high density plasma. The ions in the plasma have mass, charge and energy distribution (the plasma parameters) that are correlated to the plasma temperature and composition. In order to determine that composition, analysis of the ion beam resulting from the laser interaction is necessary. Each laser pulse or short is costly to produce. Accordingly, it is desirable to make the necessary measurements on the ion beam from only a single burst of ions. The interaction, however, provides a source of ions which have a wide energy distribution not amenable to analysis in conventional analyzers from a single burst. Accordingly, a spectrometer 14 is provided, which is shown in greater detail in FIGS. 2, 3 and 4 and provides for the analysis of the ion burst in a manner which facilitates the simultaneous determination of the mass, charge and energy spectrums thereof from each individual burst. The spectrometer has a plurality of collectors, each for ions having a common mass. These collectors are connected to a signal processor 16 which may be an oscilloscope for each collector having a camera for photographically recording the waveform of the ion current which is collected. Alternatively the signal processor may include analog-to-digital converters for digitizing the waveform and a computer for processing the digital words corresponding thereto so as to provide an analysis of the amplitude and the wave shape parameters which are correlated to the mass, charge and energy spectrum of the collected ions. The digital information may be applied to a readout unit 18 such as a digital recorder or plotter which provides a graph of each parameter.

The spectrometer 14 utilizes a time dependent electric field in order to analyze the ion beam. It will be understood that a time dependent magnetic field may also be used. The field is produced by a time dependent field producing voltage generator 20 which will be described in greater detail hereinafter in connection with FIGS. 5 and 6 of the drawings. The field varies inversely as a function of time during the period of the burst; a suitable field variation being illustrated in waveform (i) of FIG. 6. In order to initiate the field variation at the onset of the burst, a mirror 22 reflects a portion of the laser beam to a photo diode 24 to produce a voltage pulse which is applied to a trigger generator 26. The trigger generator produces a start pulse (see also waveform (a) in FIG. 6) which triggers the generator 20 to produce the variation in the field.

The sample 12 is contained in an evacuated vessel. The spectrometer 14 is contained in a housing 30 (see FIG. 2) which is connected to the vessel containing the sample 12 by way of a bellows 32. The housing is therefore evacuated, as by the same vacuum pump that evacuates the vessel. The laser beam enters the vessel through a window and produces the plasma from which the ion beam is blown off. The ion beam (see FIG. 2) thus may be considered to emanate from a source at the sample, travels a distance "L," and enters the analyzer 34 of the spectrometer at an angle "*a*" which is depicted as being 45° in FIG. 2. The angle "*a*" is formed between the plates 36 and 38 of the analyzer and the beam axis. These plates are of conductive material such as aluminum and define an analyzing region or zone in which an electric field, specifically a time dependent electric field, is established. The ions enter the analyzing region between the plates 36 and 38 through an entrance aperture 40 in the lower plate 36. Due to the field, the ions travel along different trajectories to different ones of several exit apertures 42 in the plate 36. Only the trajectory to the furthest displaced exit aperture is shown to simplify the illustration. A pair of rings 44 and 46 is disposed between the plates and extends around the periphery thereof for the purpose of rendering the field more uniform in the ends or extremes of the analyzing zone.

High voltage is applied to the plate 38 from the voltage generator 20 (FIG. 1) via a feed-through insulator 48. The lower plate 36 is grounded and voltage is applied to the rings 44 and 46 by way of a bleeder resistor or voltage divider 50 (see also FIG. 5).

Figure 3:
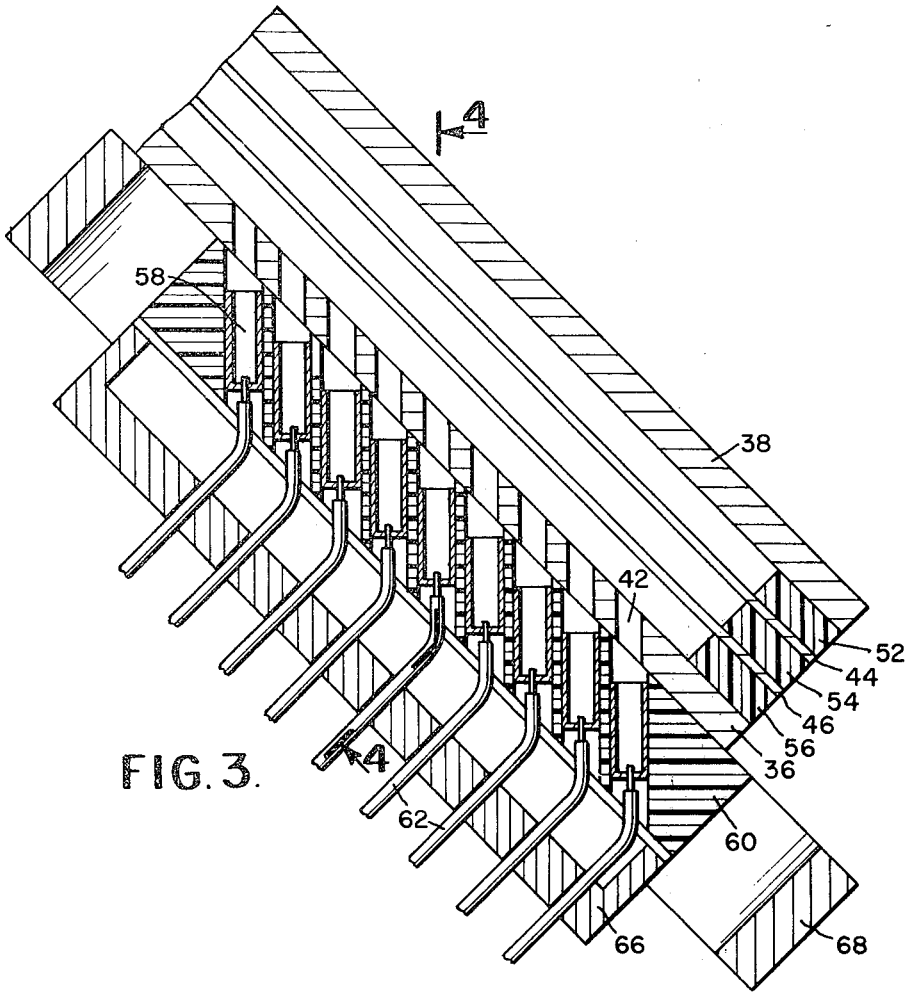
FIG. 3 is a fragmentary sectional view of the analyser of the mass spectrometer shown in FIG. 2.
Figure 4:
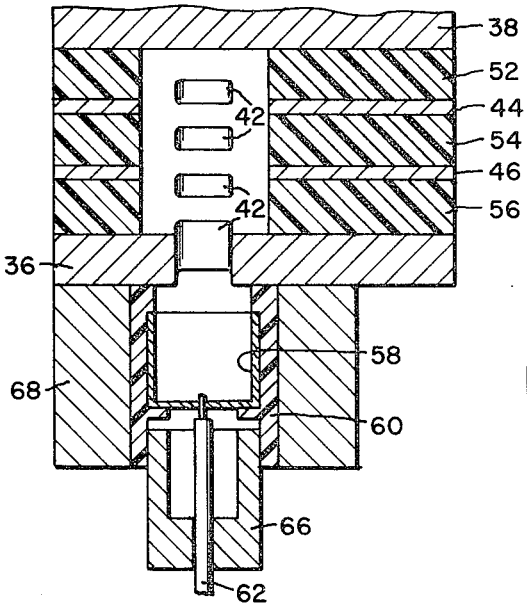
FIG. 4 is a sectional view taken along a line 4—4 of FIG. 3.

As shown in FIGS. 3 and 4, the plates 36 and 38 and the rings 44 and 46 are disposed in spaced-apart relationship by means of insulating blocks 52, 54 and 56 therebetween.

Immediately below the exit aperture there are disposed individual collector elements in the forms of conductive cups 58. These cups are assembled in an insulating block 60. Individual conductors 62 connected to the collector cups 58 provide paths for the ions, which are collected in each of the cups 58, through a feed-through insulator 64. An individual terminal is provided for each of the collector cups 58 and is connected to the signal processor 16 (FIG. 1). The conductors 62 which may be wires surrounded by an insulating sleeve are held in position by a channel 66. Surrounding the collectors 58 is a magnet 68 which serves the purpose of suppressing secondary electrons which may be generated when the ions strike the collector 58.

As the ion beam enters the housing 30 it passes through an electron repelling grid 70 and an aperture 72. The grid 70 serves to counteract space charge effects due to the expanding plasma and the aperture 72 serves to collimate the ions into the beam. The beam of ions also passes through an aperture 74 in the upper plate 38 and is incident on a collector 76 disposed within a magnet 78 which suppresses secondary electrons. The collector 76 is connected via an ammeter 80 to ground. The collector 76 thus serves as a total current probe for calibrating the spectrometer, determining the presence of the ion beam and the operational status of the system.

The source of the plasma and thus of the ion beam may be considered to be the sample at which the laser pulse interaction occurs. This sample is spaced a distance L from the entrance aperture 40 into the analyzing region. An ion having an initial velocity $V_o$ thus reaches the entrance aperture 40 at a time T equal to $L/V_o$. The voltage generator produces a voltage which when applied to the parallel plates 36 and 38 produces a time dependent electric field of the form $$E = E_o/(T+t)^2 \qquad (1)$$

where $(T+t)$ is the elapsed time interval from the beginning of the laser pulse, specifically from the time that the pulse is detected by the photo diode 24 (FIG. 1). By virtue of this time dependent field, all ions of equal q/m (charge to mass ratio) will reach the same collecting point which point is linearly spaced from the entrance aperture or slit 40 and is defined by one of the exit apertures or slits 42. In other words, for every q/m there is a corresponding point $X_{q/m}$. For an ion leaving the source and entering the analyzing region the equations of motion are:

$$\text{in the } x \text{ direction} \quad \dot{x} = v_o \cos a \quad , \qquad (2)$$

$$\text{in the } y \text{ direction} \quad \ddot{y} = \frac{q}{m} E_o \frac{1}{(T+t)^2} . \qquad (3)$$

Integrating and applying boundary conditions conditions, at $t = O$, $x = O$, $y = O$, $y = v_o \sin a$, the trajectory or ion path is given by the following equation:

$$y = \frac{q}{m} E_o \left( \ln \left\{ \frac{L + \frac{x}{\cos a}}{L} \right\} - \frac{x}{L \cos a} \right) + x \tan a. \qquad (4)$$

The last equation describes the ion trajectory in the field (viz., in the analyzing region) and shows that the trajectory is independent of $V_o$; that is, the velocity or energy of the ions. The trajectory depends only upon the particle (ion) parameters q/m and the analyzer parameters $E_o$, L, *a*, which are constants. In the limit $x/L\cos a$ approaching O a parabolic trajectory is obtained. Accordingly, through the use of the time dependent field, particles (ions) having wide energy range can be separated along different trajectories and collected so as to determine the charge and mass spectrums thereof, even though the ions are produced in a single burst.

The energy of the ions which have common q/m are measured by measuring the time dependent currents produced by the ions. In other words the current waveform or variation with time of currents collected at each of the collectors 58 produces the energy of the elemental component of the plasma collected at that collector. Thus, the energy distribution can be determined using the spectrometer shown in FIG. 2.

In the event that a time dependent magnetic field of the form $$B = \frac{B_o}{(t+T)}$$

where B is the flux density and $B_o$ is the maximum flux density were used instead of the electric field, ions would be subjected to forces determined by their charge. The force due to the magnetic field produces motion in accordance with the following equation:

$$q^{v}{}_{o}B = mw^2r \quad (5)$$

where, $r$ = radius of motion in B field, and $w$ = angular velocity in B field.

For the time dependent magnetic field as defined by equation 5 the angular velocity obtained is expressed by the following equation:

$$w = \frac{qB_o}{m(T+t)} \quad (6)$$

integrating, the angle of turning in the B field is:

$$\phi = \int_0^t w dt = \frac{B_o q}{m} \int_0^t \frac{1}{(T+t)} dt = \frac{B_o q}{m} \ln \left(\frac{t+T}{T}\right) \quad (7)$$

Since energy is conserved in this B field, $V = V_o$ along the trajectory, and when S is the path length along the trajectory, $t = S/V_o$. Since $T = L/V_o$, the angle of turning is:

$$\phi = \frac{B_o q}{m} \ln \left(1 + \frac{S}{L}\right) \quad (8)$$

which satisfies the boundary conditions at S = O and $\phi$ = O. Equation (9) describes a trajectory in the magnetic field which is independent of $V_o$ and depend only upon the particle parameters $Q/m$ and the field parameter $B_o$, for the case S/L is much less than 1 and taking ln(1+S/L) as being approximately equal to S/L, a circular trajectory is obtained. The trajectory written in Cartesian coordinates is:

$$\phi = \frac{dy}{dx} = \frac{B_o q}{m} \ln \left(1 + \frac{1}{L} \int_0^X \sqrt{1+(dy/dx)^2 dx}\right) \quad (9)$$

Accordingly, both time dependent electric fields as well as time dependent magnetic fields provide the features of the invention.

Figure 5:
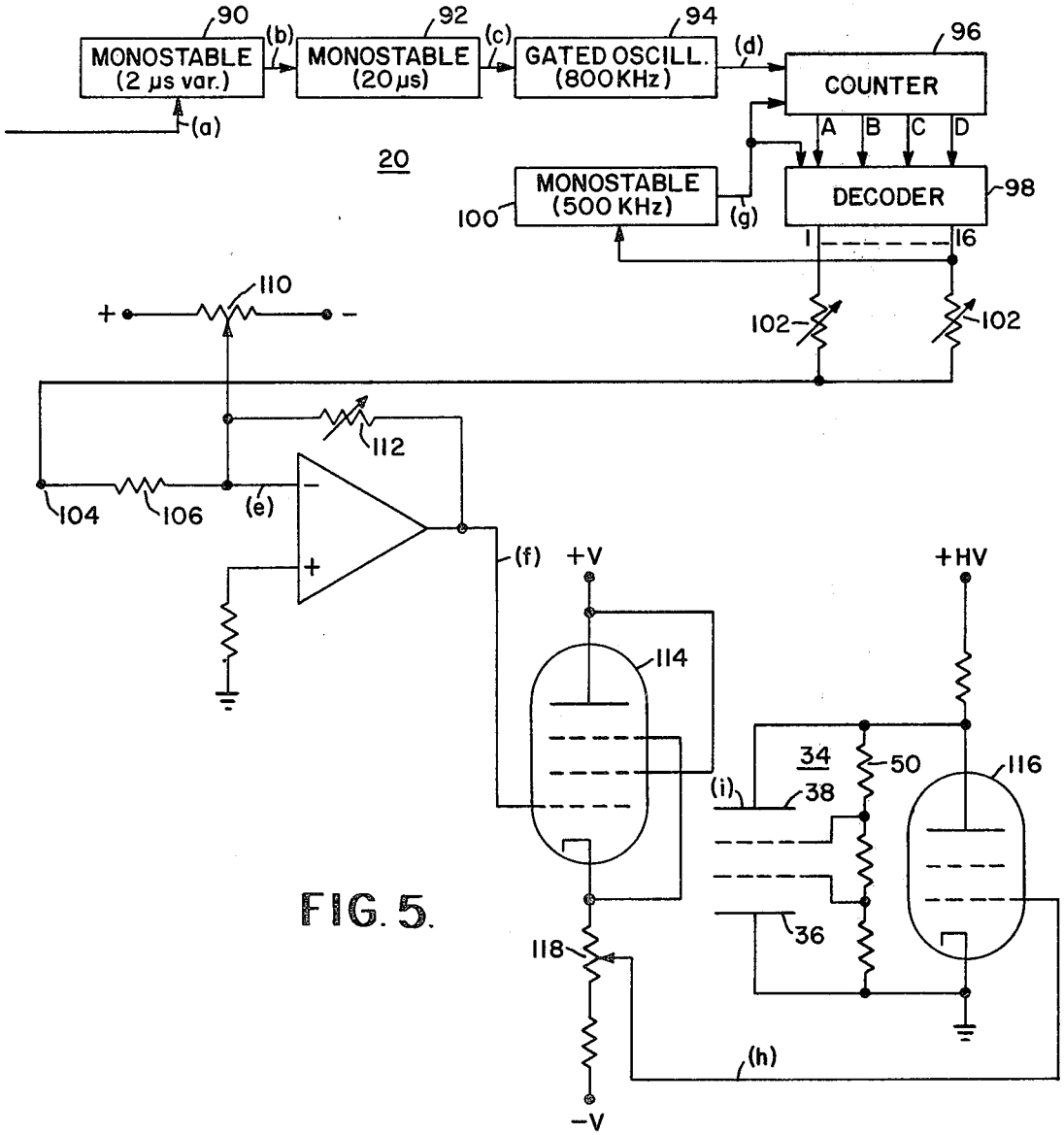
FIG. 5 is a diagram, partially in block and partially in schematic form, illustrating the time dependent field producing voltage generator of the system shown in FIG. 1.
Figure 6:
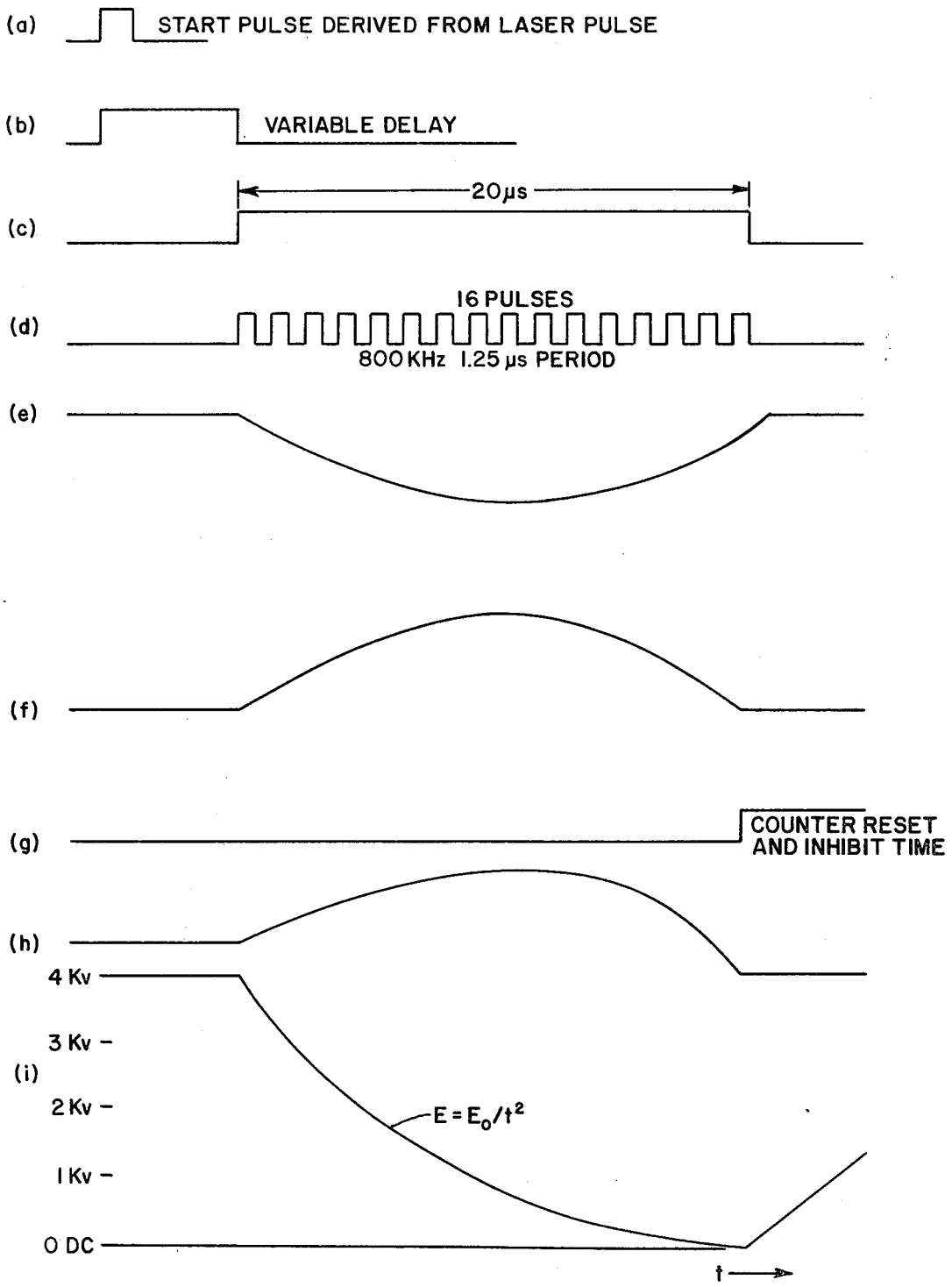
FIG. 6 is a waveform diagram illustrating the waveforms generated in the system shown in FIG. 5.

The voltage generator 20 is shown in greater detail in FIG. 5. A start pulse which is obtained at the onset of the laser pulse (waveform (*a*) FIG. 6) triggers a monostable or one-shot multivibrator 90. This one-shot may be adjustable so as to afford a variable delay; the trailing edge of the one-shot output pulse (see waveform (*b*) FIG. 6) being variable. The output pulse from the monostable 90 trigggers a second monostable or one-shot multivibrator which produces a 20 $\mu$s pulse (see waveform (*c*) FIG. 6). This pulse enables, or gates on, a gated oscillator 94 which may be a multivibrator producing a pulse train at a repetition rate of 800 KHz.

A counter 96 counts the pulses from the oscillator 94. The counter may be a binary counter which produces a binary number A, B, C, D having four bits on four output lines which are applied to the input of a decoder 98. The decoder has 16 outputs each of which receives currents for a different binary number A, B, C, D, i.e., the outputs correspond to decimal 1 to 16, or a successive one of the 16 pulses produced by the gated oscillator. When the 16th pulse is decoded a pulse is applied to another monostable or one-shot 100 which produces a counter re-set and decoder inhibit level. Thus, the counter decoder combination is operative for

16 counts or the duration of 16 oscillator pulses for each laser pulse.

Sixteen potentiometers 102 are separately connected to each of the 16 decoder outputs. The potentiometers 102 are also connected to a summing point 104 (viz., across a summing resistor 106 at the input of an operational amplifier 108). A zero balance potentiometer 110 and a potentiometer 112 in the operational amplifier feedback circuit is used for adjustment and to provide the desired output function from the input waveform (see waveform (*e*)). The output function is represented by waveform (*f*) and is applied to the control grid of a cathode follower stage 114. The cathode follower 114 drives, and provides isolation of the operational amplifier from, a high voltage output stage 116.

The cathode follower also has a potentiometer 118 in its cathode path to provide DC level control of the output voltage. The input or control voltage to the high voltage stage 116 is illustrated in waveform (*h*). The high output voltage which varies in the time dependent manner, so as to produce the time dependent field across the parallel plates 36 and 38 of the analyzer 34 is shown in waveform (*i*). It will be observed that the decoder 98 and the potentiometers 102 together with the summing operational amplifier 108 provide a digital to analog converter which generates the control voltage of proper waveform, to produce by virtue of the operation of the cathode follower stage 114 and the high voltage stage 116, the time dependent voltage which when applied to the analyzer plates 36 and 38 establishes the proper time dependent electric field.

From a reading of the foregoing description it will be apparent to those skilled in the art that there has been provided improved methods of and apparatus for spectrometry. While an illustrative spectrometer using an electric field has been described herein for purposes of illustrating the invention, it will be appreciated that variations and modifications within the scope of the invention will present themselves to those skilled in the art. For example, the analyzer can, instead of being provided by parallel plates, utilize a coaxial capacitor configuration. The ion source and the collectors can then be located on the axis of symmetry of the cylindrical plates constituting the coaxial capacitor. Other variations and modifications may also suggest themselves to those skilled in the art. Accordingly, the foregoing description should be taken merely as illustrative and not in any limiting sense of the scope of the present invention.

What is claimed is:

1. The method of mass spectrometry which comprises the steps of projecting a beam of particles which can have a wide range of kinetic energy into an analyzing region, establishing a field in said region in a direction transverse to the direction of said beam which field deflects said particles independently of their initial kinetic energy as they enter said region along paths of length which are dependent upon the mass and charge of said particles, and collecting said deflected particles at points spaced along said region from the place of entry of said beam into said region.

2. The invention as set forth in claim 1 wherein said field is established by varying said field over a period of time as an inverse function of time.

3. The invention as set forth in claim 1 including the step of projecting said beam in pulses, and initiating said field variation upon the onset of each of said pulses.

4. The invention as set forth in claim 2 wherein said field is an electric field, and said step of varying produces a variation of the intensity, E, of said field in said region of the form $E = E_o/(T+t)^2$ where Eo is the maximum intensity of said field and (T+t) is the elapsed time from the onset of each of said pulses.

5. The invention as set forth in claim 3 wherein said field is a magnetic field, and said step of varying produces a variation in the flux density, B, of said field in said region of the form $B = B_o/T+t)$ where Bo is the maximum flux density of said field and (T+t) is the elapsed time from the onset of each of said pulses.

6. The invention as set forth in claim 3 wherein said beam is produced by the step of projecting a pulse of radiant energy upon a sample to produce a plasma.

7. The invention as set forth in claim 1 including the step of detecting said radiant energy pulse, and initiating the onset of said field variation upon the detection of said radiant energy pulse.

8. The invention set forth in claim 6 including the step of forming said radiant energy pulse with a pulse laser.

9. The invention as set forth in claim 1 including the step of collecting said particles at a plurality of points spaced at different distances from the entrance of said beam into said region.

10. The invention as set forth in claim 9 including the step of processing the currents due to the particles collected at said points to determine the elemental composition of the material which produces said beam.

11. The invention as set forth in claim 10 wherein said processing step includes the step of measuring the variation of said currents at said collection points for a period of time to determine the energy of elemental constituents of the material which produces said beam.

12. A mass spectrometer adapted to analyze charged particles having a wide range of kinetic energy which comprises means defining a region for deflection of said charged particles to collection points spaced along said region from the place of entry of said particles into said region, means for establishing a field in said region which provides trajectories to said collection points independent of the initial kinetic energy of said particles upon entry into said region and dependent upon their charge to mass (q/m) ratio, said field being in a direction transverse to the direction of travel of said particles along said trajectories, and means for collecting said particles at said collection points.

13. The invention as set forth in claim 12 wherein said field establishing means includes means for producing a field which varies as an inverse function of time for a predetermined period of time.

14. The invention as set forth in claim 13 wherein said field producing means includes means responsive to the presence of said particles for initiating the variation of said field.

15. The invention as set forth in claim 14 wherein said field producing means includes means operated by said initiating means for continuing the variation of said field for a period of time commensurate with the period of time said particles are present.

16. The invention as set forth in claim 13 wherein said field establishing means includes means for providing an electric field in said region having an intensity, E, of the form $E = E_o/(t+t)^2$ where Eo is the maximum intensity of said field and (T+t) is elapsed time.

17. The invention as set forth in claim 13 wherein said field establishing means includes means for providing an electric field in said region having a flux density B of the form $B = B_o/(T+t)$ where Bo is the maximum flux density and T+t is time.

18. The invention as set forth in claim 13 including means for defining a path for a beam of ions which constitute said particles into an entrance into said region, and said collecting means includes a plurality of ion collectors each spaced at a different distance along a path extending from said entrance.

19. The invention as set forth in claim 18 includes means for providing said beam in bursts.

20. The invention as set forth in claim 19 wherein said burst providing means comprises a pulse laser which directs a laser beam upon a sample for ionizing material in said sample to produce a plasma which provides said beam.

21. The invention as set forth in claim 20 including means responsive to the presence of said laser beam for providing an output on the onset thereof, and means responsive to said output for operating said field establishing means for producing said field for a predetermined period of time commensurate with the lifetime of said plasma produced by the laser pulse.

22. The invention as set forth in claim 23 including means connected to each of said collectors for processing signals corresponding to the current due to the ions collected thereat for determining the elemental composition of said plasma.

23. The invention as set forth in claim 21 including means connected to said collectors for measuring the current due to the ions collected therein as a function of time for determining the energy distribution of the elements of which said plasma is constituted.

24. The invention as set forth in claim 16 wherein said field estblishing means includes a pair of conductive plates spaced from each other, one of said plates having an entrance aperture for said particle beam and a plurality of exit apertures spaced from said entrance aperture each at a different distance along a linear path extending from said entrance aperture, and said collecting means includes a plurality of conductive members each adjacent a different one of said exit apertures on the side thereof said one plate opposite the side thereof which faces said other plate.

25. The invention as set forth in claim 24 including a plurality of rings disposed between said plates and electrically connected thereto for providing uniformity of the field in the periphery of said region.

26. The invention as set forth in claim 24 wherein said field establishing means includes digital to analog converter means, means for providing a train of repetitive pulses of certain repetition rate, means for counting said pulses to provide a digital input to said converter, means for inhibiting said counting means when a certain number of pulses which occur during said predetermined period of time are counted, and means operated by said converter for providing a high voltage for producing a voltage of said form and means for applying said voltage across said plates.

* * * * *